US009098057B2

(12) United States Patent
Okamoto

(10) Patent No.: US 9,098,057 B2
(45) Date of Patent: Aug. 4, 2015

(54) ELECTRODE AND IMAGE FORMING APPARATUS

(71) Applicant: BROTHER KOGYO KABUSHIKI KAISHA, Nagoya-shi, Aichi-ken (JP)

(72) Inventor: Yoshihiro Okamoto, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/040,564

(22) Filed: Sep. 27, 2013

(65) Prior Publication Data

US 2014/0153952 A1 Jun. 5, 2014

(30) Foreign Application Priority Data

Nov. 30, 2012 (JP) ..... 2012-263109

(51) Int. Cl.

| | |
|---|---|
| ***G03G 15/00*** | (2006.01) |
| ***G03G 21/16*** | (2006.01) |
| ***G03G 21/18*** | (2006.01) |
| *H01R 13/24* | (2006.01) |

(52) U.S. Cl.

CPC ..... *G03G 21/1652* (2013.01); *G03G 21/1867* (2013.01); *H01R 13/2421* (2013.01)

(58) Field of Classification Search

CPC ..... G03G 21/1867
USPC ..... 399/90; 439/824
See application file for complete search history.

(56) References Cited

U.S. PATENT DOCUMENTS

| | | | | |
|---|---|---|---|---|
| 2,051,670 | A | 8/1936 | Anton | |
| 5,692,599 | A * | 12/1997 | Winter | 200/401 |
| 7,654,859 | B2 | 2/2010 | Cheng | |
| 8,000,625 | B2 * | 8/2011 | Ito et al. | 399/90 |
| 8,561,330 | B2 | 10/2013 | Sigenthaler et al. | |
| 8,608,284 | B2 * | 12/2013 | Aoki | 347/50 |
| 2001/0041079 | A1 | 11/2001 | Michlin et al. | |
| 2007/0154232 | A1 * | 7/2007 | Buchanan et al. | 399/90 |
| 2009/0214245 | A1 * | 8/2009 | Ito et al. | 399/88 |
| 2010/0239306 | A1 | 9/2010 | Souda | |

(Continued)

FOREIGN PATENT DOCUMENTS

| | | |
|---|---|---|
| JP | 2002-124231 A | 4/2002 |
| JP | 2004-250174 A | 9/2004 |

(Continued)

OTHER PUBLICATIONS

Office Action issued in U.S. Appl. No. 13/748,285, mailed Jun. 19, 2014.

(Continued)

*Primary Examiner* — David Gray
*Assistant Examiner* — Geoffrey Evans
(74) *Attorney, Agent, or Firm* — Merchant & Gould PC

(57) ABSTRACT

An electrode for an image forming apparatus, the electrode including: an elastically deformable spring portion including a wire which is spirally wound and formed in a tube shape; an electrical contact portion provided continuously to the spring portion at one side in an axial direction of the spring portion, including the wire which is wound at least twice, and formed in an annular shape, where a center axis of the annular shape extends in an intersecting direction which intersects with the axial direction of the spring portion; and an extending portion provided continuously to the electrical contact portion and extending at least in the intersecting direction.

4 Claims, 9 Drawing Sheets

(56) References Cited

U.S. PATENT DOCUMENTS

| | | | | |
|---|---|---|---|---|
| 2010/0290802 | A1* | 11/2010 | Cavill et al. | 399/90 |
| 2011/0065336 | A1 | 3/2011 | Souda | |
| 2011/0198360 | A1* | 8/2011 | Aoki | 220/694 |
| 2013/0084081 | A1* | 4/2013 | Itabashi et al. | 399/12 |
| 2013/0188982 | A1 | 7/2013 | Souda | |
| 2014/0092197 | A1* | 4/2014 | Aoi | 347/263 |
| 2014/0112679 | A1* | 4/2014 | Choi | 399/90 |
| 2014/0147159 | A1* | 5/2014 | Nishiyama et al. | 399/90 |
| 2014/0363189 | A1* | 12/2014 | Hashimoto et al. | 399/90 |
| 2014/0376943 | A1* | 12/2014 | Nishimura | 399/90 |
| 2014/0376945 | A1* | 12/2014 | Souda et al. | 399/90 |

FOREIGN PATENT DOCUMENTS

| | | | |
|---|---|---|---|
| JP | 2011-064925 | A | 3/2011 |
| WO | 2010-050613 | A1 | 5/2010 |

OTHER PUBLICATIONS

Japanese Office Action issued in JP 2012-011277, mailed Mar. 10, 2015.

* cited by examiner

ELECTRODE AND IMAGE FORMING APPARATUS

CROSS-REFERENCE TO RELATED APPLICATIONS

This application claims priority from Japanese Patent Application No. 2012-263109 filed on Nov. 30, 2012, the entire contents of which are incorporated herein by reference.

TECHNICAL FIELD

Aspects of the present invention relate to an electrode provided in an electrophotographic image forming apparatus, and an image forming apparatus provided with the electrode.

BACKGROUND

As an electrophotographic image forming apparatus, related-art discloses a printer including a housing, a cartridge accommodated in the housing, and an electrode provided in the housing and electrically connected to the cartridge.

According to the printer, for example, the electrode includes a spring portion formed in a coil spring from a metal wire, and a contact portion formed continuously with an end portion of the spring portion in a ring shape along a plane parallel with a center axis line of the spring portion. Further, the housing includes a cylinder portion that covers the spring portion, and a slit through which a portion of the contact portion is configured to protrude toward an inside of a case (e.g., see JP-A-2011-64925). The contact portion of the electrode is formed by tightly winding the metal wire twice. That is, the contact portion has two metal wires arranged parallel with each other in a contact state when seen from a radial direction of the contact portion.

In the printer, a portion of the contact portion protrudes through the slit toward the inside of the casing.

SUMMARY

However, according to the related-art printer, since a portion of the contact portion protrudes through the slit toward the inside of the casing, the contact portion of the electrode may be caught by the cartridge when exchanging the cartridge. If so, adjacent metal wires of the contact portion may be twisted and misaligned, so that the two metal wires intersect, when seen from the radial direction of the contact portion.

If the two metal wires are in an intersecting state, a contact area between the contact portion and the cartridge is decreased, as compared to a state in which two metal wires are arranged parallel with each other. This may lead to poor electrical connectivity between the contact portion and the cartridge.

In view of the above, aspects of the present invention provide an electrode capable of suppressing a wire of the electrical contact portion from being twisted and misaligned, and an image forming device including the same.

According to an aspect of the present invention, there is provided an electrode for an image forming apparatus, the electrode including: an elastically deformable spring portion including a wire which is spirally wound and formed in a tube shape; an electrical contact portion provided continuously to the spring portion at one side in an axial direction of the spring portion, including the wire which is wound at least twice, and formed in an annular shape, where a center axis of the annular shape extends in an intersecting direction which intersects with the axial direction of the spring portion; and an extending portion provided continuously to the electrical contact portion and extending at least in the intersecting direction.

According to another aspect of the present invention, there is provided an image forming apparatus including: the above-described electrode; a frame supporting the electrode, wherein the frame has an opening through which the electrical contact portion is configured to be inserted, wherein the spring portion is disposed at a second side in the axial direction of the spring portion, which is opposite to the first side in the axial direction of the spring portion, with respect to the opening, and wherein the electrical contact portion is inserted into the opening, and at least a portion of the electrical contact portion is disposed to protrude through the opening toward the first side in the axial direction than the frame.

According to another aspect of the present invention, there is provided an electrode for an image forming apparatus, the electrode including: a piece of wire including: a first portion including a spirally wound spring portion which extends in a first direction and is formed in a tube shape; a second portion connected to the first portion, including at least two windings, and formed in an annular shape, where a center axis of the annular shape extends in a second direction which intersects with the first direction; and a third portion connected to the second portion and extending at least in the second direction.

The electrode and the image forming apparatus according to the above-described aspects can suppress the wire of the electrical contact portion from being twisted and misaligned.

DETAILED DESCRIPTION

1. Overall Configuration of Printer

Figure 1:
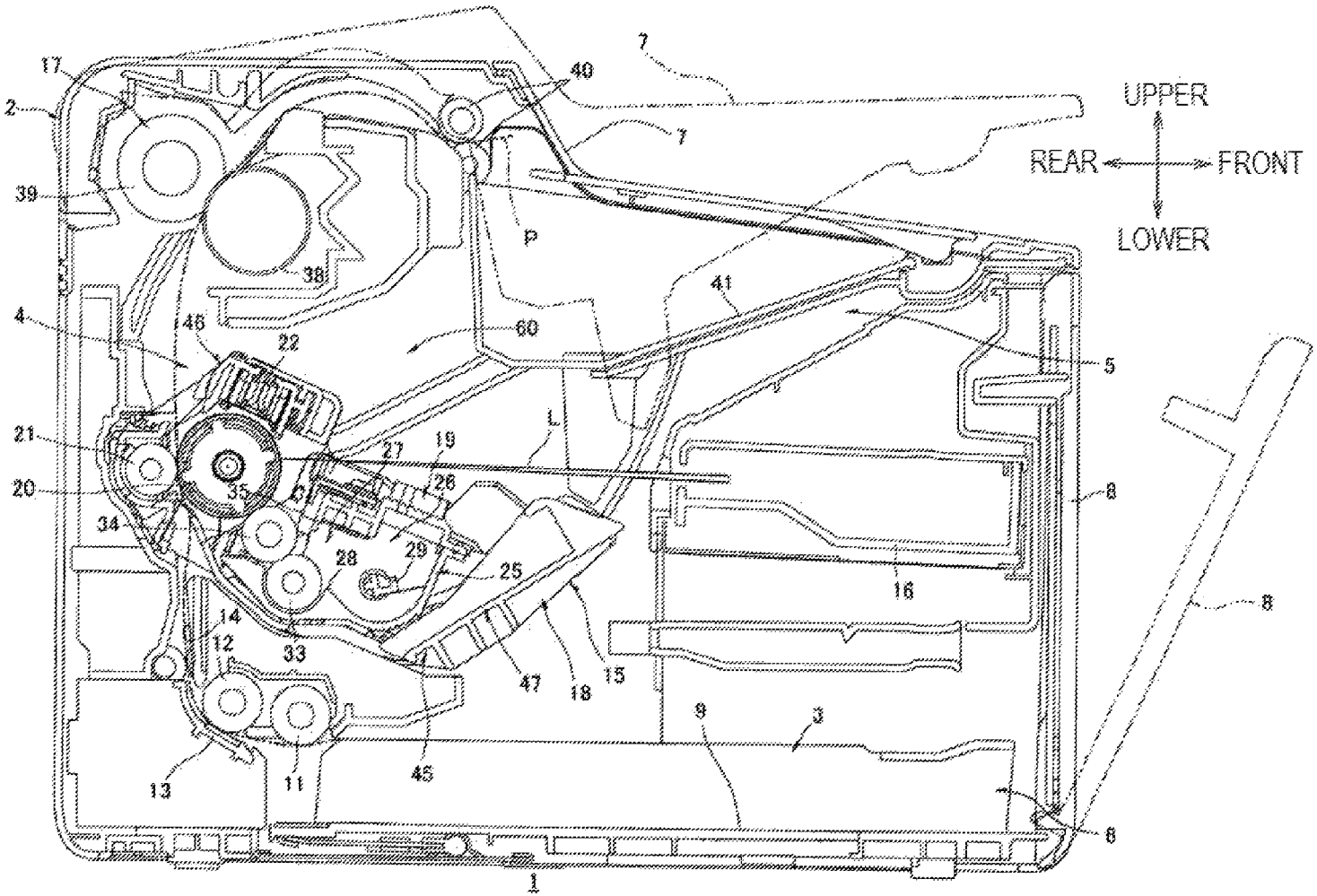
FIG. 1 is a center cross-sectional view illustrating a printer as an example of an image forming apparatus according to the present invention.

A printer 1, which is an example of an image forming apparatus, includes a body casing 2, as illustrated in FIG. 1.

The body casing 2 is formed in a substantially box shape, and includes therein a sheet feed unit 3 configured to feed sheet P which is one example of a recording medium, and an image forming unit 4 configured to form an image on the sheet P conveyed by the sheet feed unit.

It should be noted that in the following description referring to the direction, based on a state in which the printer 1 is placed horizontally, a right side of FIG. 1 is referred to as a front side, and a left side of FIG. 1 is referred to as a rear side. Further, on the basis of a left/right side when seen from the front side of the printer 1, a front side of FIG. 1 is referred to as a left side, and a side opposite to the left side is referred to as a right side. Further, an upper side of FIG. 1 is referred to as an upper side, and a lower side is referred to as a lower side. A left/right direction is one example of an axial direction, in which the left side is one side of the axial direction, while the right side is the other side of the axial direction.

(1) Body Casing

The body casing 2 is provided with a cartridge opening 5 and a sheet opening 6.

The cartridge opening 5 is formed to penetrate an upper end portion of the body casing 2 in a vertical direction, through which a process cartridge 15 which will be described later is attached or detached. That is, the cartridge opening 5 is formed such that the body casing 2 is opened upward. The sheet opening 6 is formed to penetrate a lower end portion at a front end portion of the body casing 2 in the front/rear direction, through which the sheet P is introduced.

A top cover 7 is provided at an upper end portion of the body casing 2. Further, a sheet feed cover 8 is provided at the front end portion of the body casing 2.

The top cover 7 is provided to pivot around its rear end portion as a fulcrum between a close position to close the cartridge opening 5 and an open position to open the cartridge opening 5.

The sheet feed cover 8 is provided to pivot around its lower end portion as a fulcrum between a close position to close the sheet opening 6 and an open position to open the sheet opening 6. In FIG. 1, the top cover 7 and the sheet feed cover 8 which are disposed at the close position are indicated by a solid line, while the top cover 7 and the sheet feed cover 8 which are disposed between the close position and the open position are indicated by an imaginary line (2) Sheet Feed Unit The sheet feed unit 3 includes a sheet placing portion 9 which is provided on a bottom portion of the body casing 2. The sheet placing portion 9 communicates with an exterior of the body casing 2 through the sheet opening 6.

The sheet P is stacked in a state in which the sheet feed cover 8 is disposed at the open position, such that a front portion of the sheet is stacked on a top surface of the sheet feed cover 8, while a rear portion is stacked in the sheet placing portion 9 through the sheet opening 6.

(3) Image Forming Unit

The image forming unit 4 includes the process cartridge 15, a scanner unit 16, and a fixing unit 17.

The process cartridge 15 is configured to be detachably attached to the body casing 2, and is mounted to the body casing 2 at an upper side of the rear portion of the sheet feed unit 3. The process cartridge 15 has a drum cartridge 18 detachably attached to the body casing 2, and a developing cartridge 19 detachably attached to the drum cartridge 18.

The drum cartridge 18 has a photosensitive drum 20, a transfer drum 21, and a Scorotron-type charger 22.

The photosensitive drum 20 is formed in a substantially cylindrical shape extending in the left/right direction, and is rotatably provided at the rear portion of the drum cartridge 18.

The transfer drum 21 is disposed at the rear side of the photosensitive drum 20 so that the transfer drum presses against the photosensitive drum from its rear side, and is rotatably provided to the drum cartridge 18.

The Scorotron-type charger 22 is disposed opposite to the front-upper side of the photosensitive drum 20 at a predetermined interval.

The developing cartridge 19 is disposed at the front-bottom side of the photosensitive drum 20, and has a developing frame 25.

The developing frame 25 is divided to arrange the toner accommodating chamber 26 and a developing chamber 27 in parallel in the forward/rearward direction. The toner accommodating chamber 26 and the developing chamber 27 are communicated with other via a communication port 28.

Toner is accommodated in the toner accommodating chamber 26, and an agitator 29 is provided at a substantially center portion of the toner accommodating chamber 26 in the front/rear and upper/lower direction thereof Further, the developing chamber 27 is provided with a developing roller 34, a supply roller 33, and a layer thickness regulating blade 35.

The developing roller 34 is rotatably provided to the rear end portion of the developing frame 25 so that an upper portion and a rear portion of the developing roller 34 are exposed, and comes into contact with the photosensitive drum 20 from its front-lower side.

The supply roller 33 is disposed at the front-lower side of the developing roller 34 so that it comes into contact with the developing roller 34 from its front-lower side, and is rotatably provided to the developing frame 25.

The layer thickness regulating blade 35 is supported by the developing frame 25 to come into contact with the developing roller 34 from its front side.

The scanner unit 16 is disposed at the front side of the process cartridge 15 in the body casing 2. The scanner unit 16 emits a laser beam L, which is based on the image data, toward the photosensitive drum 20, so that a peripheral surface of the photosensitive drum 20 is exposed by the laser beam.

The fixing unit 17 is disposed at the upper side of the rear portion of the drum cartridge 18 in the body casing 2. That is, the fixing unit 17 is provided at the rear end portion of the upper portion of the image forming unit 4.

The fixing unit 17 has a heating roller 38 and a pressing roller 39 which is pressed against the heating roller 38 from its rear-upper side.

(4) Image Forming Operation

The toner in the toner accommodating chamber 26 of the developing cartridge 19 is supplied onto the supply roller 33 through the communication port 28 by rotation of the agitator 29, and in turn supplied onto the developing roller 34. The toner supplied to the developing roller is positively frictionally charged between the supply roller 33 and the developing roller 34.

A thickness of the toner supplied to the developing roller 34 is restricted by the layer thickness restricting blade 35 while the developing roller 34 rotates, so that the toner is carried on the surface of the developing roller 34 as a thin film having a predetermined thickness.

Meanwhile, the surface of the photosensitive drum 20 is uniformly charged by the Scorotron-type charger 22, and then is exposed to the laser beam emitted from the scanner unit 16. In this way, the peripheral surface of the photosensitive drum 20 is formed with an electrostatic latent image based on the image data. The toner carried on the developing roller 34 is supplied to the electrostatic latent image on the peripheral surface of the photosensitive drum 20, and thus a toner image is carried on the peripheral surface of the photosensitive drum 20.

The sheet P stacked on the sheet placing portion 9 is fed between the sheet feed roller 12 and the sheet feed pad 13 by the rotation of the pickup roller 11, and is separated one by one by the rotation of the sheet feed roller 12. After that, the separated sheet P is conveyed to a sheet feed path 14 extending in the vertical direction by the rotation of the sheet feed roller 12, and then one sheet of the sheet is fed between the photosensitive drum 20 and the transfer roller 21 at a predetermined timing. The toner image is transferred to the sheet P to form the image when the sheet P passes between the photosensitive drum 20 and the transfer roller 21.

Continuously, when the sheet P passes between the heating roller 38 and the pressing roller 39, the sheet is heated and pressed by the heating roller 38 and the pressing roller 39. At that time, the image is thermally fixed on the sheet P. After that, the sheet P is conveyed between a pair of discharge rollers 40, and then is discharged onto a discharge tray 41 formed on the top cover 7 by the pair of discharge rollers 40.

In this way, the sheet P is fed from the sheet placing portion 9, and passes through the photosensitive drum 20 and the transfer roller 21. Then, after the sheet P passes between the heating roller 38 and the pressing roller 39, the sheet is conveyed along the conveying path of a substantially C-shape when seen from a side, to be discharged onto the discharge tray 41.

2. Detailed Description of Process Cartridge

Figure 2:
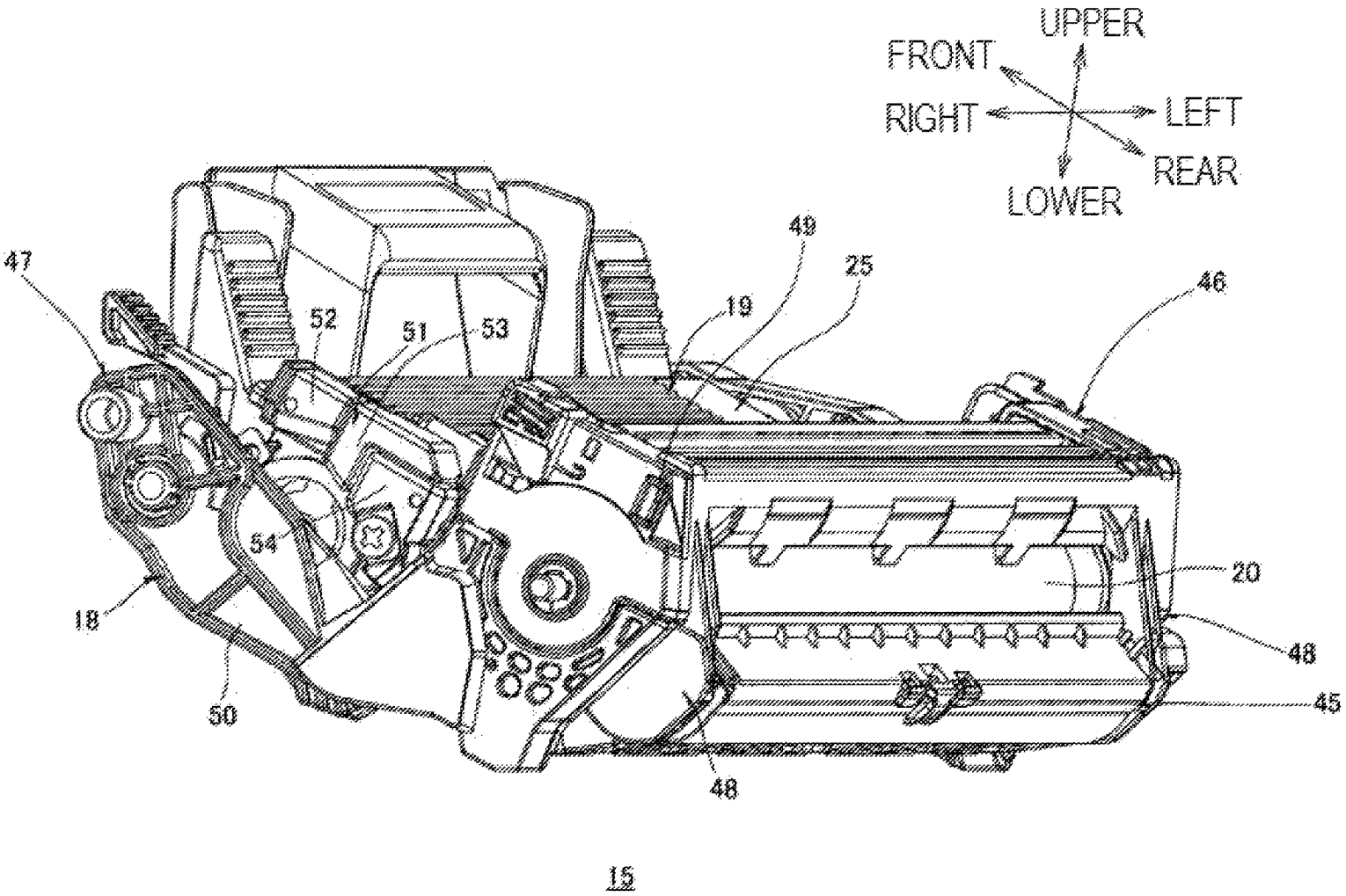
FIG. 2 is a right-upper perspective view illustrating a process cartridge in FIG. 1.

The process cartridge 15 has been described heretofore, and as illustrated in FIG. 2, includes the drum cartridge 18 and the developing cartridge 19.

Meanwhile, it should be noted that in the following description of the process cartridge 15 referring to the direction, the side of the process cartridge on which the photosensitive drum 20 is provided is referred to as a rear side of the process cartridge 15, and the side of the process cartridge on which the Scorotron-type charger 22 is provided is referred to as an upper side. That is, the upper-lower and front-rear directions of the process cartridge 15 are defined differently from the upper-lower and frontward-rearward directions of the printer 1. The process cartridge 15 is mounted to the printer 1 so that its front side becomes the front-lower side of the printer 1, and its rear side becomes the rear-upper side of the printer 1.

(1) Drum Cartridge

The drum cartridge 18 includes a drum frame 45.

The drum frame 45 has a rear section formed as a drum accommodating portion 46, and a front section formed as a cartridge mounting portion 47.

The drum accommodating portion 46 extends in the left/right direction, and is formed in a substantially box shape with its front side opened. The drum accommodating portion 46 has a pair of accommodating portion sidewalls 48 disposed opposite to each other at an interval in the left/right direction. Each of the pair of accommodating portion sidewalls 48 is formed in a shape of a substantially rectangular flat plate when seen from a side.

The right accommodating portion sidewall 48 of the pair of accommodating portion sidewalls 48 is embedded with a charger electrode 49. The charger electrode 49 is embedded in a rear-upper end portion of the right accommodating portion sidewall 48 so that it is exposed from the right side.

As illustrated in FIG. 1, the photosensitive drum 20 and the Scorotron-type charger 22 are disposed between the pair of accommodating portion sidewalls 48 of the drum accommodating portion 46.

The photosensitive drum 20 is formed in a substantially cylindrical shape extending in the left/right direction, as illustrated in FIG. 2. Further, the photosensitive drum 20 is supported in a relatively rotating manner, with both left and right end portions being supported by a substantially center portion of the corresponding accommodating portion sidewall 48.

The Scorotron-type charger 22 is formed to extend in the left/right direction, which is not illustrated herein. Further, the Scorotron-type charger 22 is supported by the drum accommodating portion 46, with both left and right end portions being supported by an upper end portion of the corresponding accommodating portion sidewall 48. In this way, the Scorotron-type charger 22 is disposed above and opposite to the photosensitive drum 20 with an interval, as illustrated in FIG. 1. Further, the Scorotron-type charger 22 is electrically connected to the charger electrode 49, which is not illustrated herein.

The cartridge mounting portion 47 is formed in a substantially box shape with its upper side opened, to allow the developing cartridge 19 to attach or detach, as illustrated in FIG. 2. The drum cartridge mounting portion 47 has a pair of mounting portion sidewalls 50 disposed opposite to each other with an interval in the left/right direction. The mounting portion sidewalls 50 extend toward the front side upwardly from the lower portion of each front end edge of the accommodating portion sidewalls 55 to form a substantially rectangular shape, when seen from a side.

The developing cartridge 19 is mounted to the cartridge mounting portion 47.

(2) Developing Cartridge

The developing cartridge 19 has a power supply unit 51 which is disposed at the right side of the developing frame 25.

The developing cartridge 19 is formed in a substantially box shape extending in the left/right direction, and its rear side is opened through which the developing roller 34 is exposed, as illustrated in FIG. 1.

The power supply unit 51 has a supply electrode 52, an insulation member 53, and a developing electrode 54, as illustrated in FIG. 2.

The supply electrode 52 is made of an electrically conductive resin material, and is supported at the right surface of the developing frame 25. The supply electrode 52 is formed in a substantially rectangular tube shape with its right end portion closed, when seen from a side. The supply electrode 52 is electrically connected to the supply roller 33, which is not illustrated herein.

The insulation member 53 is made of an insulating resin material, and is disposed at the rear side of the supply electrode 52. The insulating member 53 extends in the left/right direction, and is formed in a shape of a substantially rectangular L-shaped tube, when seen from a side of which the right end portion is closed.

The developing electrode 54 is made of an electrically conductive resin material, and is disposed at a rear-lower side of the insulating member 53. The developing electrode 54 extends in the left/right direction, and is formed in a shape of a substantially rectangular L-shaped tube, when seen from a side of which the right end portion is closed. Meanwhile, although not illustrated, the developing electrode 54 is electrically connected to the developing roller 34.

The supply electrode 52, the insulating member 53, and the developing electrode 54 are disposed at the upper side than the mounting portion sidewall 50, in the state in which the developing cartridge 19 is mounted to the cartridge mounting portion 47, and are exposed from the right side.

3. Detailed Description of Body Casing

Figure 3:
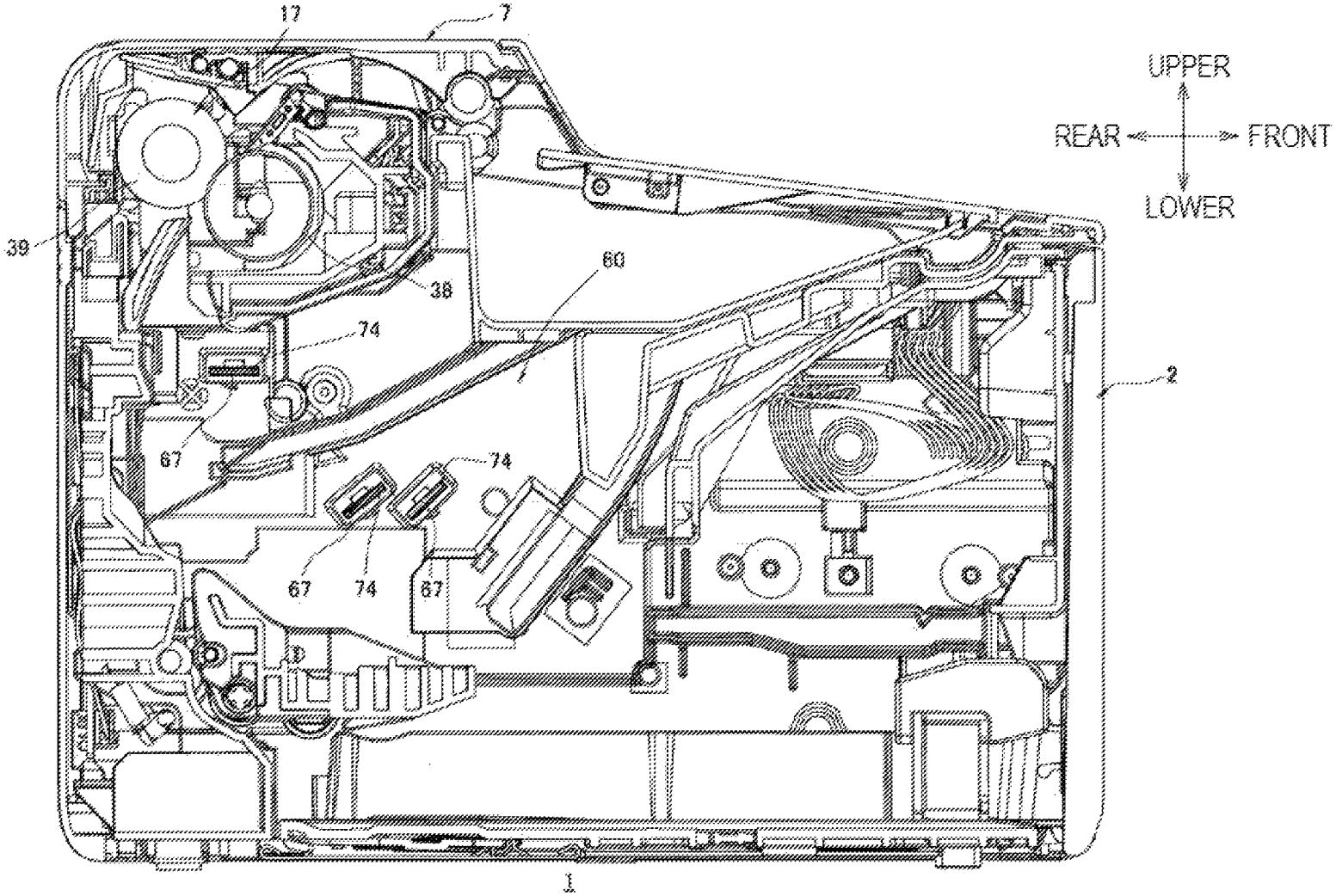
FIG. 3 is a side cross-sectional view of the printer in FIG. 1 to show a state in which the process cartridge is detached.

The body casing 2 has a pair of sidewalls 60 disposed opposite to each other at an interval in the left/right direction, as illustrated in FIG. 3.

In this embodiment, the configuration for supplying the power to the process cartridge 15 is provided only to the right sidewall 60. Thus, the right sidewall 60 will be described in detail with respect to the sidewalls 60 in the following description, and the left sidewall 60 will be not described herein. The right sidewall 60 is merely referred to as the sidewall 60. The right sidewall 60 is an example of the frame.

Figure 4:
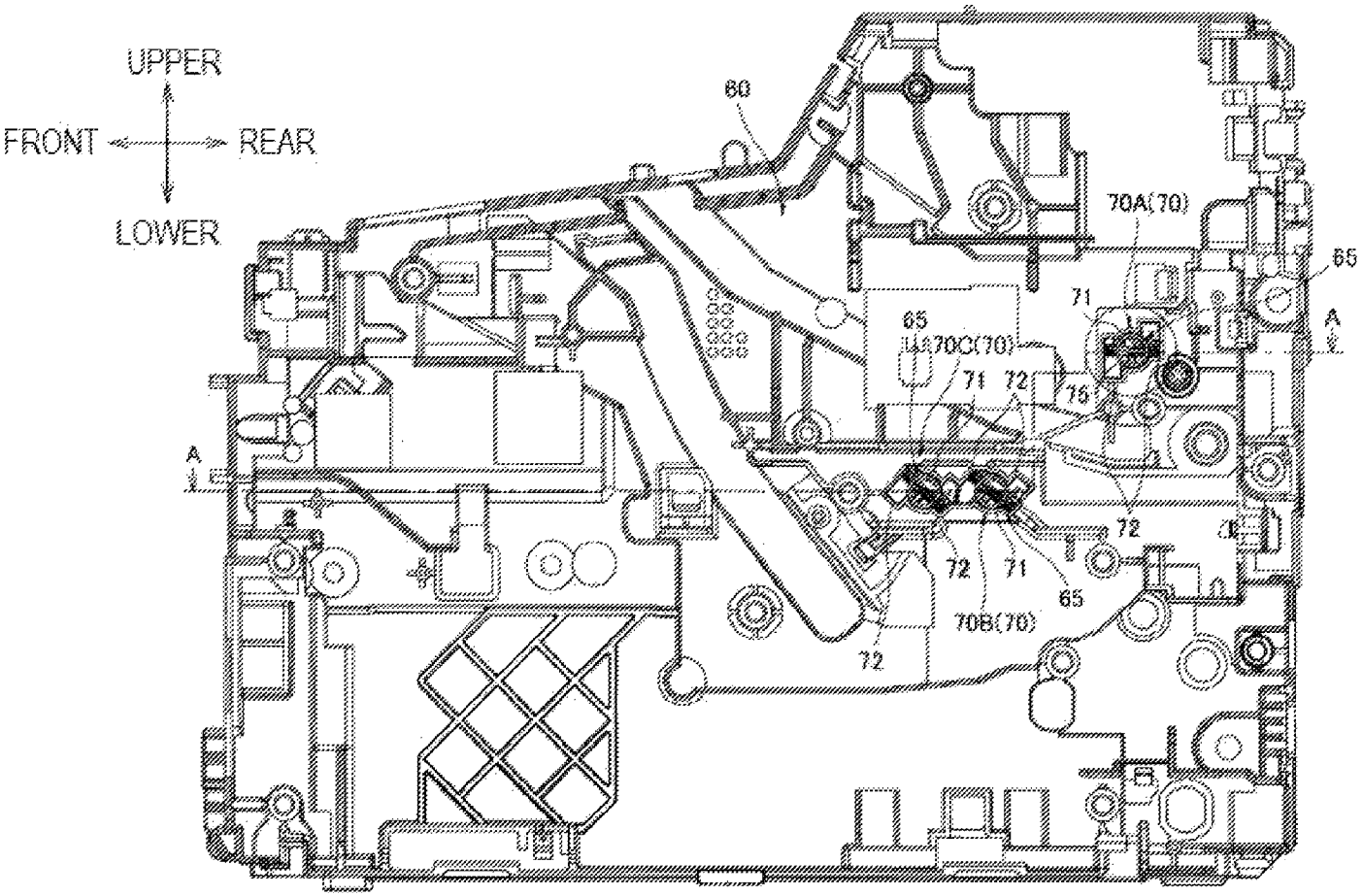
FIG. 4 is a right side view of a right sidewall in FIG. 3.

The sidewall 60 is formed in a shape of a substantially rectangular flat plate, when seen from a side extending in the front/rear direction, as illustrated in FIG. 4. Further, the right surface of the sidewall 60 is formed integrally with a plurality of relay electrode accommodating portions 70, and each relay electrode accommodating portion 70 supports a relay electrode 65, which is an example of the electrode.

Specifically, the plurality of relay electrode accommodating portions 70 has a charging relay electrode accommodating portion 70A for accommodating a relay electrode 65 applying a voltage to the Scorotron-type charger 22, a developing relay electrode accommodating portion 70B for accommodating a relay electrode 65 applying a voltage to the developing roller 34, and a supply relay electrode accommodating portion 70C for accommodating a relay electrode 65 applying a voltage to the supply roller 33.

The charging relay electrode accommodating portion 70A is provided at a substantially center portion of the rear end portion of the sidewall 60 in the vertical direction. The charging relay electrode accommodating portion 70A has a spring receiving portion 71 and an extending portion receiving portion 72.

Figure 7A:
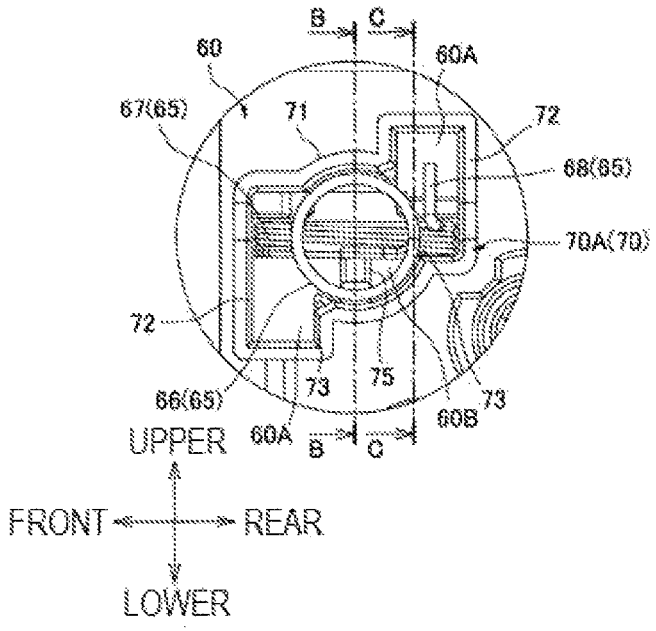
FIG. 7A is an enlarged view of a portion enclosed by a circle in FIG. 4.
Figure 7B:
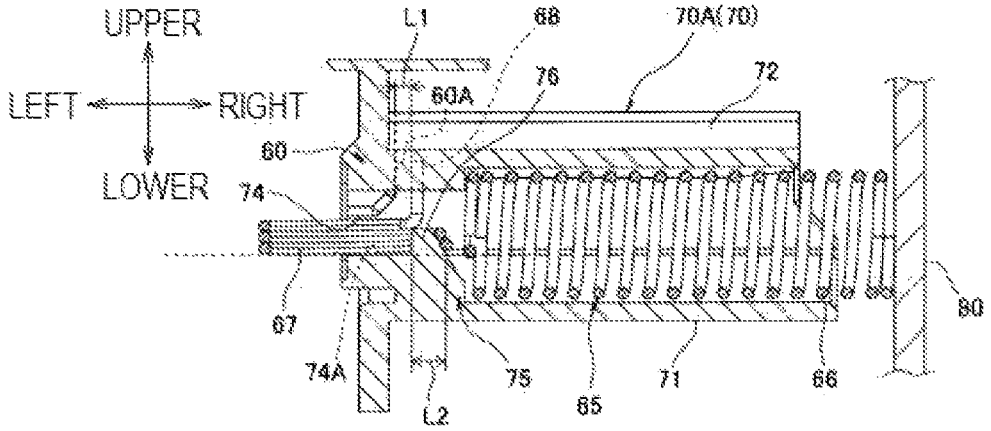
FIG. 7B is a cross-sectional view taken along the line B-B of the electrode and an electrode support portion in FIG. 7A to show a state in which the process cartridge is detached from a body casing.

The spring receiving portion 71 is formed in a substantially cylindrical shape extending from the right surface of the sidewall 60 to the right side, as illustrated in FIGS. 7A and 7B.

An inner peripheral surface of the spring receiving portion 71 is provided with an engaging portion 75. The engaging portion 75 is formed in a substantially rod shape protruding upwardly from the left-lower end portion of the inner peripheral surface of the spring receiving portion 71 in a radial direction of the spring receiving portion 71. Further, the right surface of the engaging portion 75 is formed with a notch to be slanted in the left direction toward the upper portion.

At a free end portion of the engaging portion 75, a portion opposite to an exposure hole 74, which will be described later, in the left/right direction is defined as a contact portion 76. Specifically, the contact portion 76 is disposed to be opposite to the substantially center portion of the exposure hole 74, which will be described later, in the front/rear direction thereof. The contact portion 74 protrudes inwardly in a radial direction of the spring receiving portion 71, that is, in an upward direction, than a lower edge 74A of the exposure hole 74.

The extending portion receiving portion 72 is provided in plural adjacent to the spring receiving portion 71 to be point-symmetrical around an axis of the spring receiving portion 71, that is, in a rotation symmetry of 180 degrees. Specifically, the extending portion receiving portion 72 is respectively provided adjacent to both front and rear sides of the spring receiving portion 71. The extending portion receiving portion 72 is formed in a substantially rectangular shape, when seen from a side extending in the vertical direction, and is formed in a shape of a substantially rectangular tube extending in the right side from the right surface of the sidewall 60.

An adjacent portion between the spring receiving portion 71 and the extending portion receiving portion 72 is formed with a slit 73 along its entire length in the left/right direction. The spring receiving portion 71 and the extending portion receiving portion 72 are communicated with each other in the front/rear direction via the slit 73.

The charging relay electrode accommodating portion 70A is formed so that its length in the front/rear direction is slightly longer than a length of an electrical contact portion 67 in the front/rear direction, which will be described later, and its length in the left/right direction is shorter than a length of the spring portion 66 in the left/right direction, which will also be described later.

Further, the sidewall 60 in the charging relay electrode accommodating portion 70A is formed with the exposure hole 74, which penetrates the sidewall. The exposure hole 74 is an example of the opening, and is illustrated in FIG. 3.

The exposure hole 74 is formed in a substantially rectangular shape, when seen from a side extending in the left/right direction. Specifically, the exposure hole 74 is formed along a sidewall 60B in the spring receiving portion 71 and a sidewall 60A in the extending portion receiving portion 72 of both front and rear sides, and is disposed to overlap with the axis of the spring receiving portion 71. Further, the exposure hole 74 is formed to have a shape and size that is substantially the same as a shape and size of the electrical contact portion 67 when seen in the left/right direction.

The developing relay electrode accommodating portion 70B is disposed at the front-lower side of the charging relay electrode accommodating portion 70A with an interval, as illustrated in FIG. 4, and the supply relay electrode accommodating portion 70C is disposed at the front side of the developing relay electrode accommodating portion 70B.

Each of the developing relay electrode accommodating portion 70B and the supply relay electrode accommodating portion 70C is configured to be slanted at an angle of about 45 degrees in a clockwise direction when seen from the right side of the charging relay electrode accommodating portion 70A on the basis of the axis of the spring receiving portion 71. Thus, in the description of the developing relay electrode accommodating portion 70B and the supply relay electrode accommodating portion 70C, same portions as those of the charging relay electrode accommodating portion 70A are respectively indicated by the same reference numeral, and will not be described herein.

Figure 6A:
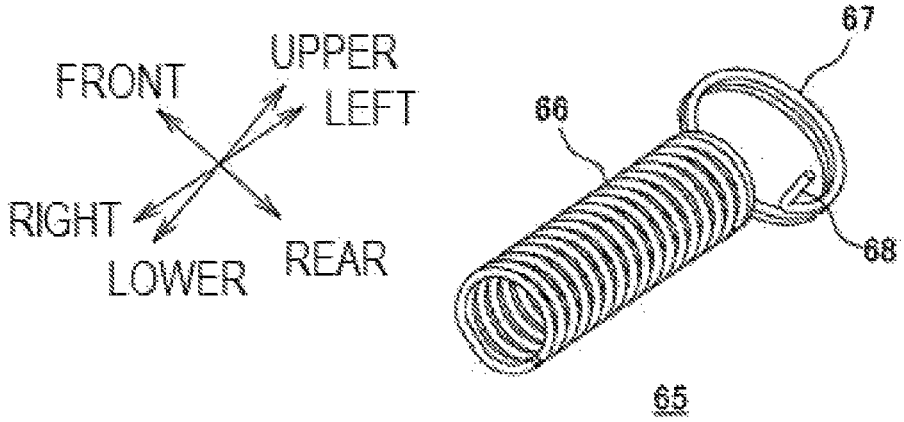
FIG. 6A is a right-front perspective view of an electrode in FIG. 5.
Figure 6B:
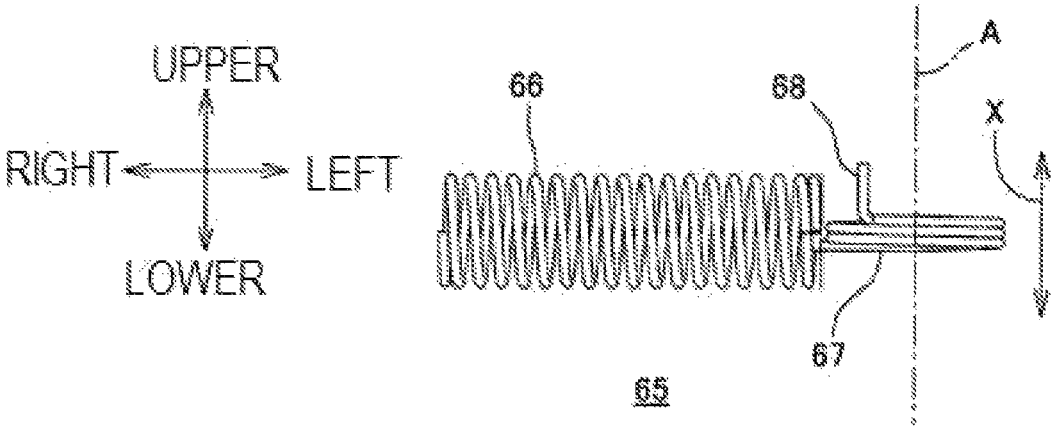
FIG. 6B is a rear view of the electrode in FIG. 6A.

The relay electrode 65 is formed by bending a wire having electrical conductivity and elasticity, such as one metal wire, as illustrated in FIGS. 6A and 6B. Meanwhile, the relay electrodes 65 respectively supported by the charging relay electrode accommodating portion 70A, the developing relay electrode accommodating portion 70B, and the supply relay electrode accommodating portion 70C have the same structure. For this reason, in the following description of the relay electrodes 65, the configuration of the relay electrode 65 accommodated in the charging relay electrode accommodating portion 70A will be described, and the description of the relay electrodes 65 each accommodated in the developing relay electrode accommodating portion 70B and the supply relay electrode accommodating portion 70C will be omitted herein.

The relay electrode 65 has the spring portion 66, the electrical contact portion 67, and an extending portion 68 which are integrally formed.

The spring portion 66 is formed by spirally winding the wire in the left/right direction to be formed in a tube shape extending in the left/right direction. In this way, the spring portion 66 is formed in a shape of an air core coil extending in the left/right direction, and is configured to be elastically deformed in the left/right direction.

The electrical contact portion 67 is formed continuously to the left end portion of the spring portion 66, and is also formed in a substantially ring shape by winding the wire three times. The electrical contact portion 67 has a center axis A which extends in a direction X perpendicular to the axial direction of the spring portion 66. That is, the perpendicular direction X is an example of the intersecting direction. More specifically, the electrically contact portion 67 is formed in the substantially ring shape, with the center axis A extending in the upper/lower direction.

The extending portion 68 extends continuously to an end portion of the wire forming the electrical contact portion 67 along the perpendicular direction X to be spaced apart from the electrically contact portion 67. More specifically, the extending portion 68 extends upward to be spaced apart from the electrical contact portion 67.

Further, the extending portion 68 is disposed between the center axis A and the left end portion of the spring portion 66 so that it is spaced apart from the center axis A of the electrical contact portion 67 and the left end portion of the spring portion 66 at a substantially same interval in the left/right direction.

Each relay electrode 65 is received in the corresponding relay electrode receiving portion 70 along the left/right direction, so that the electrical contact portion 67 is inserted into the exposure hole 74 and the spring portion 66 is inserted into the spring receiving portion 71, as illustrated in FIGS. 7A and 7B.

In this way, the left portion of the electrical contact portion 67 protrudes through the exposure hole 74 towards the left side than the left surface of the sidewall 60B. Further, the spring portion 66 is disposed at the right side with respect to the sidewall 60B, that is, the right side with respect to the exposure hole 74, and the right end portion of the spring portion 66 is exposed to the right side from the spring receiving portion 71.

The extending portion 68 is disposed in the rear extending portion receiving portion 72, and faces the sidewall 60A with an interval in the left/right direction. In this way, the extending portion 68 is disposed to overlap with the sidewall 60A, when viewed in the left/right direction. The contact portion 76 of the engaging portion 75 is inserted into the electrical contact portion 67.

Figure 5:
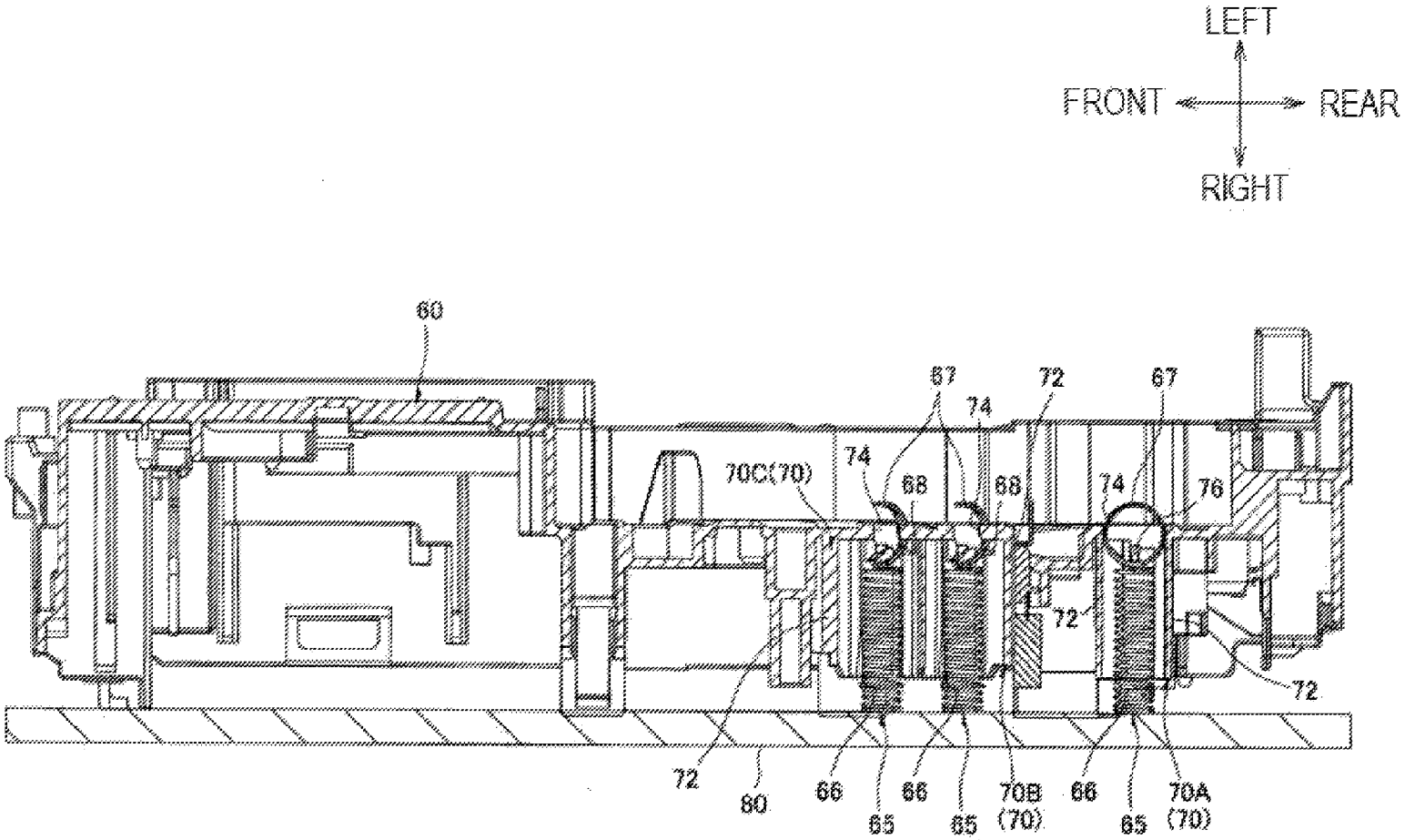
FIG. 5 is a cross-sectional view taken along the line A-A of the right sidewall in FIG. 4.

Further, the right side of the sidewall 60 is provided with a power supply substrate 80, as illustrated in FIG. 5.

The power supply substrate 80 is an electric circuit substrate having a transformer, a capacitor, or the like, and is configured to amplify a voltage supplied from the input power (not illustrated), accumulate the amplified voltage in the capacitor, or supply the power to each electrode and each wiring.

The right end portion of each relay electrode 65 comes into contact with the left surface of the power supply substrate 80, and is electrically connected with the power supply substrate 80.

In this way, the electrical contact portion 67 of each relay electrode 65 is always biased toward the left direction by a biasing force of the spring portion 66.

Figure 7C:
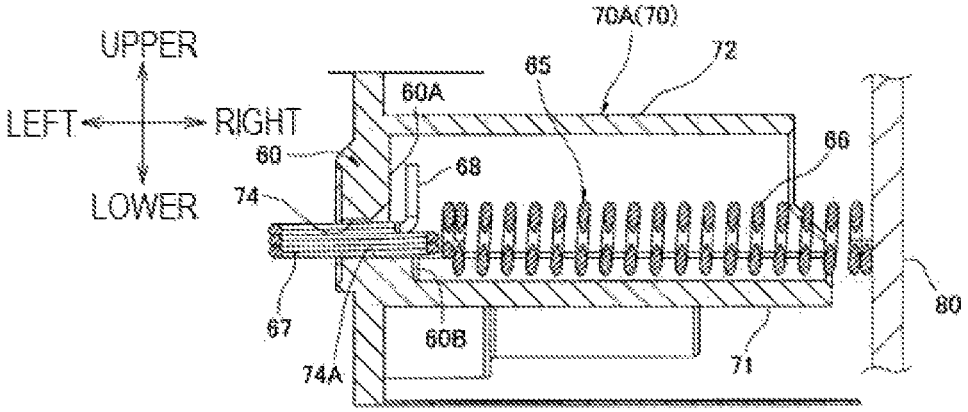
FIG. 7C is a cross-sectional view taken along the line C-C of the electrode and the electrode support portion in FIG. 7B to show the state in which the process cartridge is detached from the body casing.

For this reason, as illustrated in FIGS. 7B and 7C, the right end portion of the electrical contact portion 67 and the contact portion 76 of the engaging portion 75 are always brought into contact with each other on the inner peripheral surface of the electrical contact portion 67, and the electrical contact portion 67 is restricted to further movement toward the left direction. That is, an amount of the electrical contact portion 67 protruding toward the left side than the left surface of the sidewall 60B is restricted by the contact portion 76.

The extending portion 68 is disposed to face the sidewall 60A with an interval L1 in the left/right direction in the state in which the electrical contact portion 67 and the contact portion 76 are brought into contact with each other. The interval L1 is shorter than a length L2 of the contact portion 76 in the left/right direction.

4. Supply Power to Process Cartridge

Next, the supply of the power to the process cartridge 15 will now be described.

If the power is supplied to the process cartridge 15, the process cartridge 15 is first mounted onto the printer 1, as illustrated in FIG. 1.

Figure 8A:
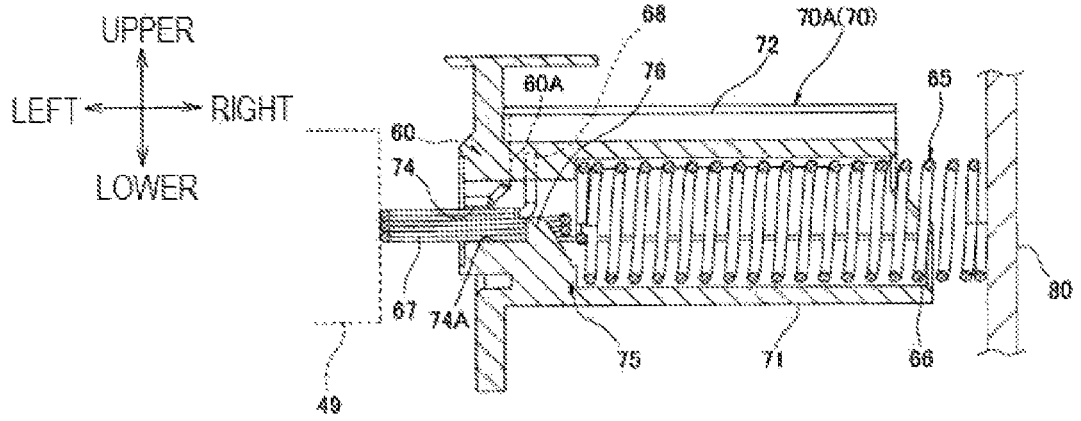
FIG. 8A is a cross-sectional view taken along the line B-B of the electrode and the electrode support portion in FIG. 7A to show a state in which the process cartridge is mounted to the body casing.

If the process cartridge 15 is mounted onto the printer 1, as illustrated in FIG. 8A, the charger electrode 49 of the drum cartridge 18 comes into contact with the electrical contact portion 67 of the relay electrode 65, which is accommodated in the charging relay electrode accommodating portion 70A, from the left side.

And, the electrical contact portion 67 is moved to the right side against the biasing force of the spring portion 66. In this way, the electrical contact portion 67 is pressed against the charger electrode 49 by the biasing force of the spring portion 66. For this reason, the charger electrode 49 is electrically connected with the power supply substrate 80 via the relay electrode 65.

Although not illustrated, if the process cartridge 15 is mounted onto the printer 1, the developing electrode 54 comes into contact with the electrical contact portion 67 of the relay electrode 65, which is accommodated in the developing relay electrode accommodating portion 70B, from the left side, and the supply electrode 52 comes into contact with the electrical contact portion 67 of the relay electrode 65, which is accommodated in the supply relay electrode accommodating portion 70C, from the left side. In this way, each of the supply electrode 52 and the developing electrode 54 is electrically connected with the power supply substrate 80 via the corresponding relay electrode 65.

At the image forming operation described above, the voltage is applied to the Scorotron-type charger 22 from the power supply substrate 80 via the relay electrode 65 and the charger electrode 49. Further, the voltage is respectively applied from the power supply substrate 80 to the supply roller 33 via the relay electrode 65 and the supply electrode 52, and to the developing roller 34 via the relay electrode 65 and the developing electrode 54.

5. Exchanging Operation of Developing Cartridge

When the lifetime of the developing cartridge 19 has elapsed in the printer 1, the process cartridge 15 is demounted from the body casing 2, and then the developing cartridge 19 of the process cartridge 15 is exchanged.

At the image forming operation, in a case where the sheet P is jammed on the conveying path, the process cartridge 15 is demounted from the body casing 2, and then the jammed sheet P is removed through the cartridge opening 5.

For this reason, at the operation of exchanging the developing cartridge or removing the jammed sheet P, the left portion of the electrically contact portion 67 protruding in the left side than the left surface of the sidewall 60B may be caught by the process cartridge 15.

If the left portion of the electrical contact portion 67 is caught by the process cartridge 15, the electrical contact portion 67 will be pulled in the left direction.

Figure 8B:
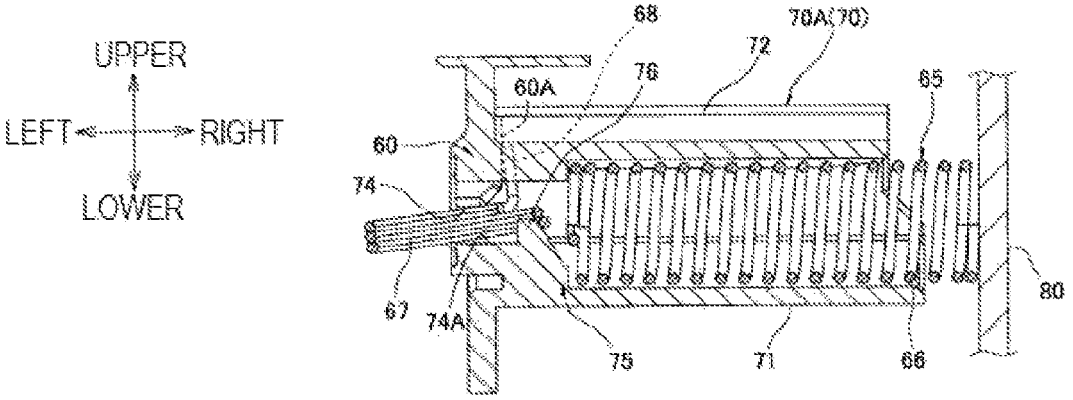
FIG. 8B is a cross-sectional view taken along the line B-B of the electrode and the electrode support portion in FIG. 7A to show a state in which the electrical contact portion is pulled.

In this case, the right end portion of the electrical contact portion 67 is moved toward the left-upper side along the slope of the contact portion 76, as illustrated in FIG. 8B. The extending portion 68 provided continuous to the electrical contact portion 67 is tilted in the left direction with the movement of the electrical contact portion 67, so that the upper end portion of the extending portion 68 is brought into contact with the right surface of the sidewall 60A. In this way, the movement of the electrical contact portion 67 in the left direction is restricted.

If the catching of the electrical contact portion 67 and the process cartridge 15 is released, the right end portion of the electrical contact portion 67 is moved toward the right-lower side along the slope of the contact portion 76. In this way, the electrical contact portion 67 is moved to the original position before it is caught by the process cartridge 15, as illustrated in FIGS. 7B and 7C.

6. Effects (1) The relay electrode 65 has the spring portion 66, the electrical contact portion 67, and the extending portion 68, as illustrated in FIGS. 6A and 6B. The spring portion 66 is formed which by spirally winding one metal wire in the left/right direction to be formed in the tube shape, and the electrical contact portion 67 is formed continuously to the left end portion of the spring portion 66, and is also formed in the substantially ring shape by winding the wire three times, of which the center axis A extends in the direction X perpendicular to the axial direction of the spring portion 66. Further, the extending portion 68 extends continuously to the end portion of the wire forming the electrical contact portion 67 along the perpendicular direction X to be spaced apart from the electrically contact portion 67.

For this reason, as illustrated in FIG. 8B, if the electrical contact portion 67 is caught by the process cartridge 15 in the state in which the relay electrode 65 is supported in the relay electrode accommodating portion 70, the extending portion 68 and the right surface of the sidewall 60 can be brought into contact with each other.

As a result, it is possible to prevent deformation of the electrical contact portion 67 continuous to the extending portion 68, and it is possible to suppress the wire continuous to the electrical contact portion 67 from being twisted and misaligned.

(2) Further, the extending portion 68 extends in the direction of being spaced apart from the electrical contact portion 67, as illustrated in FIG. 6B. For this reason, as illustrated in FIG. 8B, if the electrical contact portion 67 is caught by the process cartridge 15 in the state in which the relay electrode 65 is supported in the relay electrode accommodating portion 70, the extending portion 68 and the right surface of the sidewall 60 can be reliably brought into contact with each other.

(3) In the printer 1, as illustrated in FIGS. 7A to 7C, the left portion of the electrical contact portion 67 protrudes through the exposure hole 74 towards the left side than the left surface of the sidewall 60B. For this reason, as illustrated in FIG. 8A, the electrodes provided on the process cartridge 15, that is, the charge electrode 49, the supply electrode 52, and the developing electrode 54 can be reliably brought into contact with the electrical contact portion 67 of the corresponding relay electrode 65, respectively. As a result, it is possible to reliably electrically connect the relay electrodes 65 with the charger electrode, the supply electrode 52, and the developing electrode 54, respectively.

Further, even though the left portion of the electrical contact portion 67 is caught by the process cartridge 15, as illustrated in FIG. 8B, since the relay electrode 65 has the extending portion 68 provided continuously to the electrical contact portion 67, the extending portion 68 can be brought into contact with the right surface of the sidewall 60A.

For this reason, it is possible to prevent deformation of the electrical contact portion 67 continuous to the extending portion 68, and it is possible to suppress the wire continuous to the electrical contact portion 67 from being twisted and misaligned.

(4) Further, the exposure hole 74 is formed such that a shape and a size thereof is substantially the same as a shape and a size of the electrical contact portion 67 when seen in the left/right direction, as illustrated in FIG. 3. Also, the extending portion 68 overlaps with the sidewall 60A, when seen in the left/right direction, as illustrated in FIG. 7A.

For this reason, if the electrical contact portion 67 is caught by the process cartridge 15 and thus is pulled in the left direction, as illustrated in FIG. 8B, the extending portion 68 and the right surface of the sidewall 60 can be reliably brought into contact with each other.

(5) Further, the relay electrode accommodating portion 70 of the sidewall 60 is provided with the contact portion 76, as illustrated in FIG. 7B.

The electrical contact portion 67 is restricted to further movement toward the left direction by the contact of its right end portion against the contact portion 76. For this reason, the amount of the electrical contact portion 67 protruding toward the left side than the left surface of the sidewall 60B is restricted by the contact portion 76.

Therefore, the amount of the electrical contact portion 67 protruding toward the left side than the left surface of the sidewall 60B can be maintained constant, thereby suppressing the electrical contact portion 67 from being caught by the process cartridge 15, while the relay electrodes 65 are reliably electrically connected to the charger electrode 49, the supply electrode 52, and the developing electrode 54, respectively.

(6) Further, as illustrated in FIG. 7B, the interval L1 between the extending portion 68 and the sidewall 60A in the left/right direction is shorter than the length L2 of the contact portion 76 in the left/right direction in the state in which the electrical contact portion 67 comes into contact with the contact portion 76. For this reason, when the electrical contact portion 67 is caught by the process cartridge 15 and thus is pulled in the left direction, the extending portion 68 comes into contact with the right surface of the sidewall 60A before the electrical contact portion 67 climbs over the contact portion 76. As a result, it is possible to suppress the relay electrode 65 from being released from the sidewall 60.

7. Modifications

In the above-described printer 1, as illustrated in FIG. 7A, the relay electrode 65 is accommodated in the corresponding extending portion receiving portion 72, respectively, so that the extending portion 68 is disposed in the extending portion receiving portion 72 at the rear side. However, the present invention is not limited thereto. The relay electrode 65 may be accommodated in the corresponding extending portion receiving portion 72, respectively, so that the extending portion 68 is disposed in the extending portion receiving portion 72 at the front side.

That is, since the extending portion receiving portion 72 is provided to be point-symmetrical around an axis of the spring receiving portion 71, it is possible to accommodate the relay electrode 65 inside the extending portion receiving portion 72 even if the relay electrode 65 is rotated 180 degrees around the axis of the spring portion.

Therefore, it is possible to facilitate the mounting operation of the relay electrode 65 to the extending portion receiving portion 72.

The present invention provides illustrative, non-limiting examples as follows:

(1) In a first aspect, there is provided an electrode for an image forming apparatus, the electrode including: an elastically deformable spring portion including a wire which is spirally wound and formed in a tube shape; an electrical contact portion provided continuously to the spring portion at one side in an axial direction of the spring portion, including the wire which is wound at least twice, and formed in an annular shape, where a center axis of the annular shape extends in an intersecting direction which intersects with the axial direction of the spring portion; and an extending portion provided continuously to the electrical contact portion and extending at least in the intersecting direction.

(2) In a second aspect, there is provided the electrode according to the first aspect, wherein the extending portion extends in a direction away from the electrical contact portion.

(3) In a third aspect, there is provided an image forming apparatus including: the electrode according to the first aspect or the second aspect; a frame supporting the electrode, wherein the frame has an opening through which the electrical contact portion is configured to be inserted, and wherein the electrical contact portion is inserted into the opening, and at least a portion of the electrical contact portion is disposed to protrude through the opening toward the one side in the axial direction than the frame.

(4) In a fourth aspect, there is provided the image forming apparatus according to the third aspect, wherein, when seen in the axial direction, a shape and a size of the opening of the frame is substantially the same as a shape and a size of the electrical contact portion, and wherein, when seen in the axial direction, the extending portion overlaps with the frame.

(5) In a fifth aspect, there is provided the image forming apparatus according to the fourth aspect, wherein the frame includes a contact portion coming into contact with the electrical contact portion to regulate a protrusion amount of the electrical contact portion protruding toward the one side in the axial direction than the frame, and wherein the extending portion faces the frame with an interval in the axial direction when the electrical contact portion comes into contact with the contact portion.

(6) In a sixth aspect, there is provided the image forming apparatus according to the fifth aspect, wherein a length of the contact portion in the axial direction is formed to be longer than the interval between the extending portion and the frame in the axial direction when the electrical contact portion comes into contact with the contact portion.

(7) In a seventh aspect, there is provided an electrode for an image forming apparatus, the electrode including: a piece of wire including: a first portion including a spirally wound spring portion which extends in a first direction and is formed in a tube shape; a second portion connected to the first portion, including at least two windings, and formed in an annular shape, where a center axis of the annular shape extends in a second direction which intersects with the first direction; and a third portion connected to the second portion and extending at least in the second direction.

(8) In an eighth aspect, there is provided the electrode according to the seventh aspect, wherein the second direction is substantially perpendicular to the first direction.

(9) In a ninth aspect, there is provided the electrode according to the seventh aspect, wherein the second portion is connected to the first portion via a first bent portion.

(10) In a tenth aspect, there is provided the electrode according to the seventh aspect, wherein the third portion is connected to the second portion via a second bent portion.

What is claimed is:

1. An image forming apparatus, comprising:

an electrode, including:

an elastically deformable spring portion including a wire which is spirally wound and formed in a tube shape;

an electrical contact portion provided continuously to the spring portion at one side in an axial direction of the spring portion, including the wire which is wound at least twice, and formed in an annular shape, where a center axis of the annular shape extends in an intersecting direction which is parallel to the center axis of the annular shape, and is perpendicular to and intersects with the axial direction of the spring portion; and an extending portion provided continuously to the electrical contact portion and extending at least in the intersecting direction, a frame supporting the electrode, wherein the frame has an opening through which the electrical contact portion is configured to be inserted, and wherein the electrical contact portion is inserted into the opening, and at least a portion of the electrical contact portion is disposed to protrude through the opening toward the one side in the axial direction than the frame.

2. The image forming apparatus according to claim 1, wherein, when seen in the axial direction, a shape and a size of the opening of the frame is substantially the same as a shape and a size of the electrical contact portion, and wherein, when seen in the axial direction, the extending portion overlaps with the frame.

3. The image forming apparatus according to claim 2, wherein the frame includes a contact portion coming into contact with the electrical contact portion to regulate a protrusion amount of the electrical contact portion protruding toward the one side in the axial direction than the frame, and wherein the extending portion faces the frame with an interval in the axial direction when the electrical contact portion comes into contact with the contact portion.

4. The image forming apparatus according to claim 3, wherein a length of the contact portion in the axial direction is formed to be longer than the interval between the extending portion and the frame in the axial direction when the electrical contact portion comes into contact with the contact portion.

* * * * *